United States Patent [19]

Kausch

[11] 4,407,536

[45] Oct. 4, 1983

[54] SINGLE THROW MULTI-GRIP LATCHING MECHANISM

[75] Inventor: Marvin L. Kausch, San Jose, Calif.

[73] Assignee: Cromemco Inc., Mt. View, Calif.

[21] Appl. No.: 235,167

[22] Filed: Feb. 17, 1981

[51] Int. Cl.[3] ..... E05C 5/00

[52] U.S. Cl. ..... 292/29; 292/68; 292/113; 292/DIG. 31

[58] Field of Search ..... 292/7, 26, 29, 40, 48, 292/52, 66, 68, 63, 64, 109, 110, 113, 116, 117, 118, 119, 256, DIG. 31

[56] References Cited

U.S. PATENT DOCUMENTS

| | | | |
|---|---|---|---|
| 703,962 | 7/1902 | Lydon | 292/113 |
| 2,652,277 | 9/1953 | Anderson | 292/66 X |
| 2,904,141 | 9/1959 | Henrichs | 292/113 X |
| 3,026,133 | 3/1962 | Swanson | 292/DIG. 31 X |
| 3,352,585 | 11/1967 | Crosswell et al. | 292/113 X |

FOREIGN PATENT DOCUMENTS

| | | | |
|---|---|---|---|
| 559567 | 7/1958 | Canada | 292/113 |
| 975421 | 11/1961 | Fed. Rep. of Germany | 292/113 |
| 1222501 | 1/1960 | France | 292/113 |
| 316416 | 10/1969 | Sweden | 292/DIG. 31 |
| 253939 | 12/1926 | United Kingdom | 292/113 |

*Primary Examiner*—Thomas J. Holko
*Attorney, Agent, or Firm*—Paul Hentzel

[57] ABSTRACT

The door on an environmental chamber is provided with a single throw, multi-fingered over-center latching mechanism. The latching fingers extend from a common pivoting assembly, and are operated as a unit by a single handle. A hook on the end of each finger engages a post on the chamber housing. As the handle is operated, the over-center action of the pivoting assembly pulls the door towards the housing causing the gasket to seat. The over-center structure biases the latching mechanism in the latched position.

14 Claims, 6 Drawing Figures

SINGLE THROW MULTI-GRIP LATCHING MECHANISM

TECHNICAL FIELD

This invention relates to rapidly seating large peripheral gaskets around an environmental chamber access port, and more particularly to a single action, multi-grip over-center latch for establishing and maintaining the gasket seat.

BACKGROUND

Heretofore, large peripheral gaskets were seated by bolting a cover to a peripheral flange. Tight, uniform seals required many bolts positioned close together. In order to close and seal the access port, an entire set of nuts (or bolts) had to be removed by the operator. Proper seating and closing required the operator to replace and systematically tighten each nut. The prior art bolting approach to large gasket sealing was time consuming and required hand tools. In addition, the nuts and bolts were small and were easily misplaced when removed from the flange.

SUMMARY

It is therefore an object of this invention to provide an improved single throw multi grip latch for more conviniently seating and unseating large peripheral gaskets.

It is another object of this invention to provide an access port latch for quickly seating or unseating a gasket which does not involve tools or separate parts.

It is a further object of this invention to provide a latching mechanism which may be rapidly adjusted for controlling gasket seating pressure.

It is a further object of this invention to provide a latching device in which the required adjustment may be visually inspected by the operator while in the latched position.

It is a further object of this invention to provide an environmental chamber in which all of the access and latching structure is flush with the housing surface when closed and latched.

Briefly, these and other objects of the present invention are accomplished by providing a housing with an access port and a closure member hinged to the housing for covering the access port and seating a gasket around the access port. The latching structure is connected to the closure member in over-center relationship through a series of linkage members therebetween. Multiple fingers extend from the latching structure to engage shoulders formed in the housing. As the latching structure is pivoted by the operator, the linkage members pull the closure member firmly against the housing, seating the gasket therebetween.

BRIEF DESCRIPTION OF THE DRAWING

Further objects and advantages of the latching structure and the operation of the over-center latch mechanism will become apparent from the following detailed description and drawing in which.

DETAILED DESCRIPTION

Figure 1:
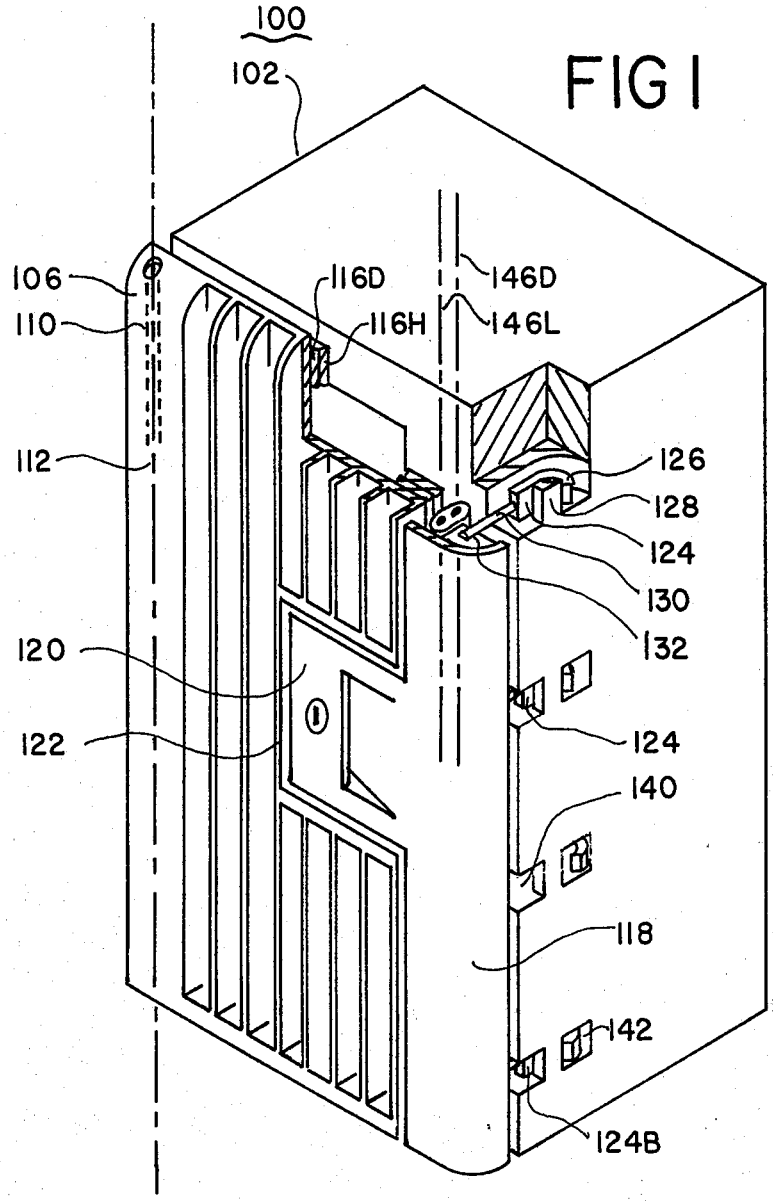
FIG. 1 is a perspective view of an environmental chamber with the access door in the latched position showing the latching structure partially cut-away.

FIG. 1 shows environmental chamber 100 formed by housing 102 and closure member or door 106, pivotally secured thereto for closing over access port 108. A suitable hinging structure between housing 102 and door 106, such as vertical hinge pin 110 (shown in hidden lines) defines the open-close pivoting axis 112 of door 106.

Peripheral housing gasket 116H and door gasket 116D are placed into contact as door 106 is closed. Over-center latching assembly 118 is then pivoted into the latched position by the operator, forcing gaskets 116 into seated engagement. The operator pushes handle 120 into shallow depression 122 causing over-center latching assembly 118 to pivot, pulling on an array of latching fingers 124 extending from assembly 118. Each finger 124 terminates in a flange or hook portion 126 which partially "wraps around" an associated shoulder or post 128 for securing assembly 118 in the latched position. The over-center action of the latching structure urges door 106 against the housing with the gaskets seating therebetween.

Latching fingers 124 are vertically spaced along latching assembly 118 to distribute the seating pressure, and to prevent stress warping of assembly 118 and door 106. Top latching finger 124T may be positioned at a height near the top strip of gaskets 116 in order to apply maximum seating pressure directly thereto. The seating force required to compress the gaskets is greater proximate top finger 124T due to the horizontal length of the top strips. Bottom finger 124B is similarly positioned near the bottom strip of gaskets 116.

Figure 2:
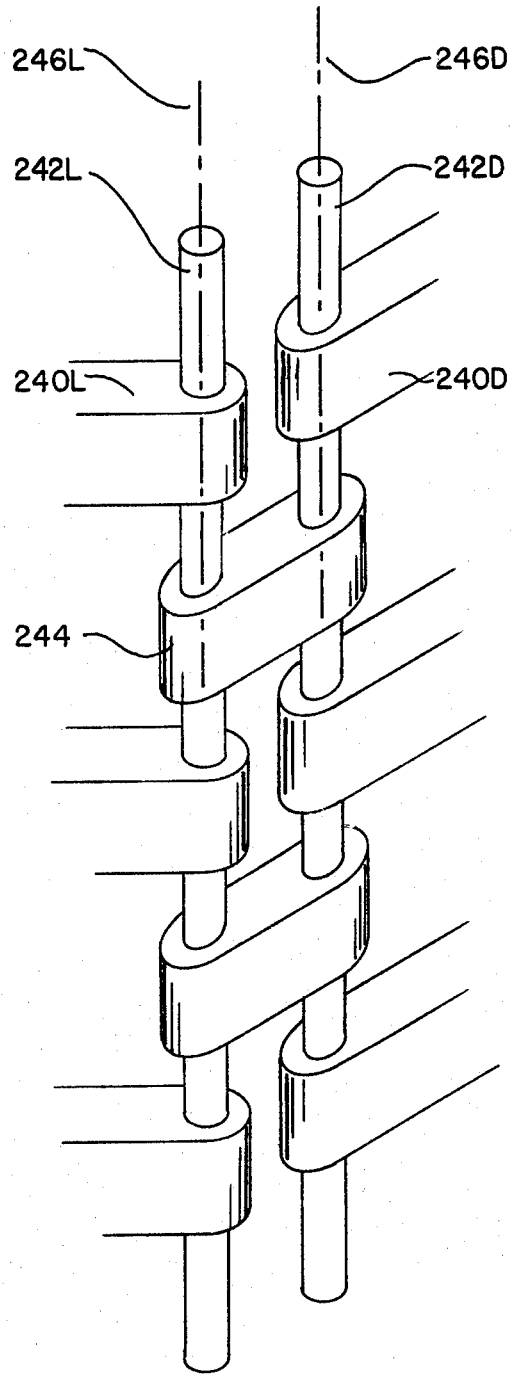
FIG. 2 is a fragmentary, perspective view showing the over-center linkage of the latching structure.

FIG. 2 shows the internal structure of latching assembly 118. A set of casting bosses 240D extend from door 106. A another set of casting bosses 240L extend from latching assembly 118 forming opposed pairs with bosses 240D. A linking pin 242D passes through bosses 240D, and a similar parallel latching pin 242L passes through bosses 240L. Over-center linkage members 244 are positioned between each pair of opposed bosses 240 to couple pins 242. Pins 242 are rotatably engaged by bosses 240, linkage members 244, or both, defining linking axis 246D and latching axis 246L.

Figure 3:
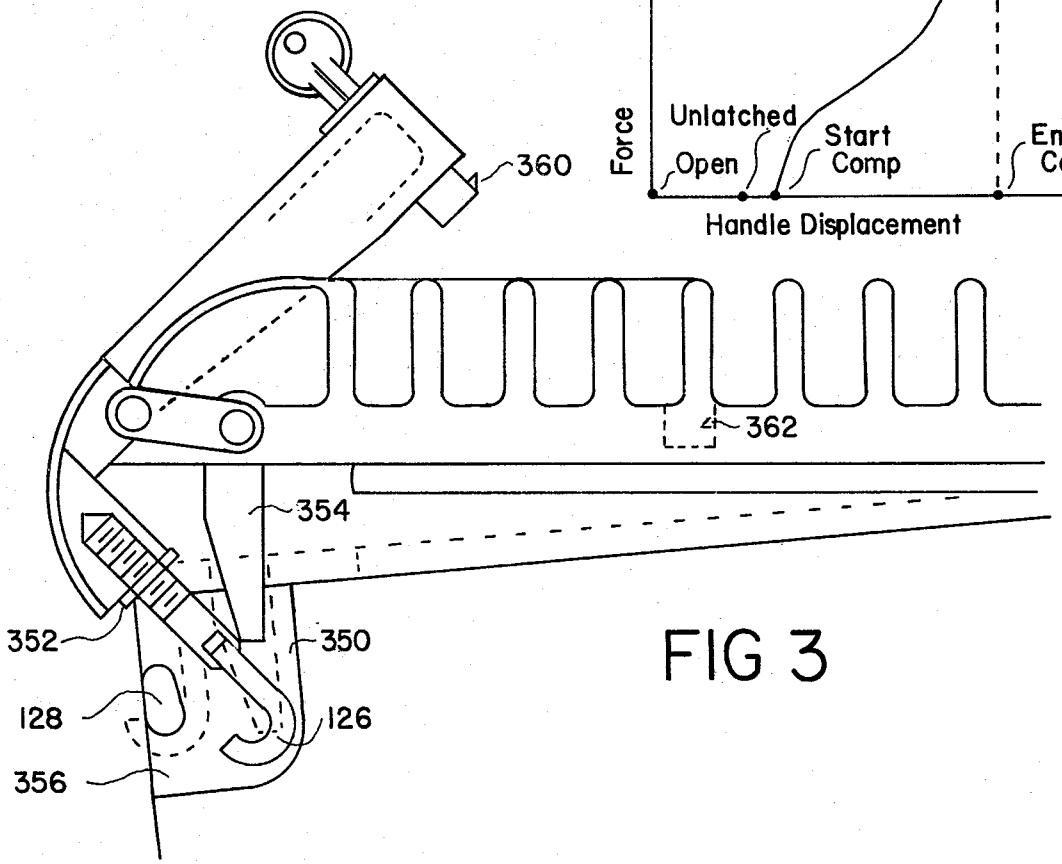
FIG. 3 is a sectional top view of a latching structure of the type in FIG. 1 in the closed but unlatched position (solid lines) showing the displacement thereof to the latched position (dashed lines)

FIG. 3 shows the operation of latching assembly 118 as the operator pivots handle 120 from the unlatched position (solid lines), through the gasket compression cycle to the latched position (dashed lines). The operator swings door 106 from the open position to the latched position as shown causing each latching finger 124 to enter a housing cavity 350 and come to rest with latching hook 126 proximate housing shoulder 128. An array of finger guides such as stops 354 may be employed to establish alinement between each finger and cavity. In addition, stops 354 prevent hooks 126 from inadvertently getting caught between gaskets 116 and marring the seating surfaces thereof.

The operative length of each finger 124 may be shortened to increase the seating force by turning the finger CW at least one complete turn. Threaded shank portion 130 of the finger penetrates one pitch spacing further into a correspondingly threaded aperture 132 in latching assembly 118. A CCW rotation of fingers 124 lengthens the exposed portion of shank 130 by one pitch spacing, reducing the seating pressure. Middle top finger 124Mt and middle bottom finger 124Mb may be adjusted to further distribute the seating pressure and minimize stress bending of door 106. The operator may accomplish the operative length adjustment without hand tools by turning hook 126. However, jam nut 352 may be provided to lock the fingers at a particular length; and will require a conventional handwrench to loosen and tighten.

As the operator pushes handle 120 into the latched position, latching assembly 118 pivots on latching axis 246L. Pivoting initially places hooks 126 into contact with shoulders 128. Further pivoting causes assembly 118 to swing outward from housing 102 on linkage members 244 about axis 242D in over-center fashion. Door 106 is drawn closer to housing 102 by the outward displacement of latching pin 242L relative to linkage pin 242D, forcing gaskets 116 into seating engagement. A final further pivot of assembly 118, forces locking catch 360 past striker plate 362 into the locked position.

Figure 4:
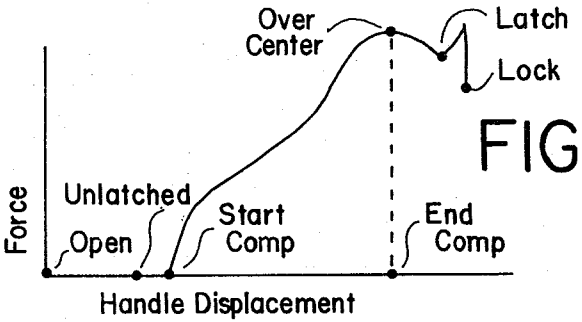
FIG. 4 is a diagram of gasket seating pressure verses handle position, showing the relative force required to displace the latching assembly of FIG. 3 through the sequence of operating positions.

FIG. 4 shows the seating force applied to gaskets 116 while the operator pivots latching assembly 118. Zero seating force is involved in swinging door 106 from the open position to the closed but unlatched position. The gasket compression cycle is initiated when hooks 126 contact posts 128. The seating force rises steeply as the opposed strips of gasket 116 along the door hinge engage and compress together. The seating force rises at a slower rate as the area of gasket engagement extends across the top and bottom strips of gasket towards latching assembly 118. A second steep rise in seating pressure occurs as the gasket strips along latching assembly 118 engage and seat together. The required compression force peaks as latching pin 242L passes over the center of linking pin 242D, and decreases symmetrically as handle 120 reaches the latched position within depression 122. The negative slope of the force curve at the latched position, secures latching assembly 118 in the latched position. A slight additional displacement of latching assembly 118 advances handle 120 to the locked position.

When in the locked position, the side surface of latching assembly 118 is flush with the side surface of housing 102. In addition, fingers 124 and posts 128 are within the interior of housing 102, and do not extend beyond the side plane of the housing. These structural features permit environmental chamber 100 to be readily rack mounted. The front surface has a similar flush construction in the latched position. The front surface of latching assembly 118 is flush with the front surface of door 106, and handle 120 fits flush into depression 122. The entire front of chamber 100 is free of any hazardous extending structures such as handles etc.

Figure 5:
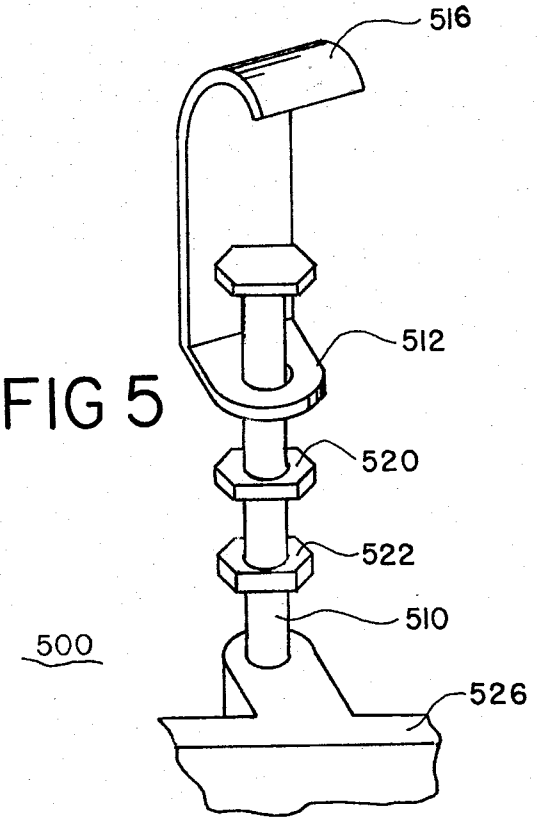
FIG. 5 is a fragmentary, perspective view of continuously adjustable latching finger in which the latching flange is releaseably secured to the head of a threaded bolt.

FIG. 5 shows a three piece embodiment 500 of a latching finger which is continuously adjustable in length, as opposed to the rotation increment adjustment of the FIG. 1 embodiment. The operative length of threaded bolt member 510 is varied to effect the desired change in gasket pressure as described hereinbefore. However, the base portion 512 of hook member 516 may be disengaged from bolt 510 by backing off lock nut 520, permitting hook member 516 to rotate independently of bolt member 510. After the length of bolt member 510 has been adjusted, hook member 516 is returned to the proper engagement orientation, and nut 520 is retightened against base portion 512. Jam nut 522 is provided to secure bolt to casting boss 526. If desired, bolt 510 may be adjusted while door 106 is latched, through adjustment opening 140.

Fine adjustments in seating pressure are effected by turning bolt member 510 a few degrees CW or CCW. Large changes in seating pressure are effected by larger changes in the length of the exposed portion of bolt member 510. This exact control of the length of finger 500 allows the operator to compensate for aging and maintain a precise gasket pressure throughout the life of the environmental chamber. The primary aging effects are gasket set and mechanical stretching or "creep" along the length of the fingers.

Figure 6:
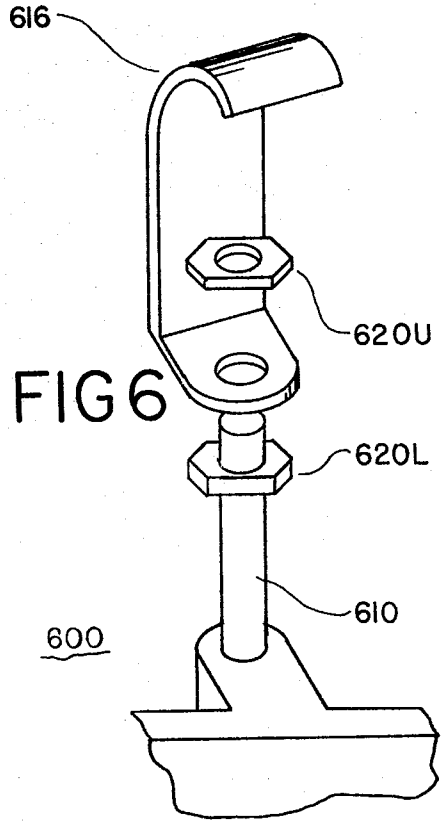
FIG. 6 is a fragmentary, perspective view of another continuously adjustable latching finger in which the threaded member is a stud extending from the latching mechanism.

FIG. 6 shows a continuous adjustment embodiment in which the threaded member is a stud 610 extending from the latching assembly. The position of hook 616 is adjusted by repositioning upper nut 620U and lower nut 620L.

Preferrably, the length of each finger is initially adjusted so that the hook member contacts the associated post simultaneously as the operator pivots the latching assembly from the unlatched position to the start of the compression cycle. This simultaneous contact is permitted by the continuous adjustment capability of finger 500. The need for major adjustments of finger length and hook position may be detected by visual inspection of each post engagement through side apertures 356 into cavities 350. In the FIG. 1 embodiment, latching finger 124M:1 is visibly separated from shoulder 128M:1, while the other fingers are in shoulder contact. The operator may make a rough correction of the hook position by opening door 106 and turning finger 124M:1 one or two complete revolutions. A feeler gauge may be employed to detect minor adjustments in finger length made possible through the continuously adjustable embodiments of FIGS. 5 and 6.

INDUSTRIAL APPLICABILITY

It will be apparent to those skilled in the art that the objects of this invention have been achieved by providing a latching assembly which pivots in over-center relationship with the door and housing. An array of hooked fingers provide multi-latching between the door and the housing for distributing the sealing pressure along the gasket length. The fingers are adjustable for controlling the gasket pressure. The latching assembly is flush with the housing and door when latched.

CONCLUSION

Clearly various changes may be made in the structure and embodiments shown herein without departing from the concept of the invention. For example, the number and spacing of the fingers may vary from the embodiment shown. Post 128 may be replaced by a shoulder along the inner surface of cavity 350, permitting hook 126 to extend toward the housing. Rods 242 may be formed by a series of short rod segments which combine to define the linking axis and the latching axis. Further, the features of the embodiments shown in the various Figures may be employed with the embodiments of the other Figures.

Therefore, the scope of the invention is to be determined by the terminology of the following claims and the legal equivalents thereof.

I claim as my invention:

1. An environmental chamber having an operator access port which may be quickly unlatched opened closed and latched by the operator, and having a peripheral gasket which is reseated after each operator access, comprising;

a housing forming the chamber, with an elongated access port therein;

an elongated closure means for covering the access port, having a pair of opposed elongated sides;

hinge means for hingedly securing the closure means to the housing along an open-close axis proximate one of the elongated sides of the closure means;

peripheral gasket means seated between the housing and the closure means when the closure means is latched for sealing the access port;

over-center linking means pivotally secured to the elongated closure means along a linking axis proximate the unhinged elongated side thereof;

over-center latching structure extending along the unhinged elongated side of the closure means, and pivotally secured to the over-center linking means along a latching axis displaced from the linking axis;

a plurality of spaced latching fingers positioned along the latching structure and extending therefrom toward the housing;

threaded means on each latching finger for adjusting the operative length thereof;

latching flange means formed at the end of each latching finger;

a plurality of correspondingly spaced shoulder means on the housing for releaseably engaging the latching flange means;

a plurality of cavities in the housing, one positioned next to each shoulder means for receiving the latching fingers;

finger stop means extending from the latching structure next to each latching finger for guiding the latching fingers into the cavity to a position proximate the shoulder means; and a handle portion extending from the latching structure by which the operator pivots the latching structure and swings the latching axis along an arc about the linking axis towards the over-center position relative to the linking axis, causing the flange means to engage the shoulder means to pull the unhinged side of the closure means closer to the housing causing the peripheral gasket means to seat around the access port, and for further pivoting beyond the over-center position to bias the latching structure in the latched position.

2. The environmental chamber of claim 1, wherein the over-center linking means is a plurality of linking members pivotally secured between the latching structure and the closure means.

3. The environmental chamber of claim 2, wherein the plurality of over-center linking members are spaced along the latching structure in the space between adjacent latching fingers.

4. The environmental chamber of claim 3, wherein the linking axis is formed by a rod means extending through the closure means and through one end of each of the plurality of over-center linking members.

5. The environmental chamber of claim 4, wherein the latching axis is formed by a rod means extending through the latching structure and through the other end of each of the plurality of over-center linking members.

6. The environmental chamber of claim 5, wherein the linking axis rod means and the latching axis rod means are formed by a pair of parallel rods.

7. The environmental chamber of claim 1, wherein each latching finger has a threaded shank which engages a corresponding threaded aperture in the closure means for adjusting the operative length of the latching finger.

8. The environmental chamber of claim 7, wherein the latching fingers are one piece rigid members formed by the threaded shank at one end and the flange means at the other.

9. The environmental chamber of claim 1, wherein the flange means extend away from the housing.

10. The environmental chamber of claim 9, wherein each cavity has a side aperture through which the operator may visually inspect the engagement between the flange means and the shoulder.

11. The environmental chamber of claim 1, wherein the surface of the latching structure is flush with the surface of the closure means and with the surface of the housing when the closure means is latched.

12. The environmental chamber of claim 11, wherein the handle may be pivoted by the operator beyond the latched position to a locked position in which the handle portion is flush with the surface of the closure means.

13. The environmental chamber of claim 1, wherein each latching finger is formed by:

a threaded shank member adjustably engaging the latching assembly;

a hook member releaseably secured to the shank member for engaging the shoulder means; and a releaseable threaded means engaging the shank member for securing the hook member to the shank member after the shank member has been adjusted to the desired operative length.

14. The environmental chamber of claim 1, wherein each latching finger is formed by:

a threaded stud extending from the latching assembly;

a hook member releaseably secured to the end of the threaded stud; and a releasable threaded means engaging the stud for securing the hook member to the stud.

* * * * *